US007798142B2

(12) United States Patent
Morgan et al.

(10) Patent No.: US 7,798,142 B2
(45) Date of Patent: Sep. 21, 2010

(54) VALVE SYSTEM FOR UNDERWATER DIVING EQUIPMENT

(75) Inventors: William Bevly Morgan, Santa Barbara, CA (US); Connie Lyn Morgan, Santa Barbara, CA (US); Trent Matthew Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 1082 days.

(21) Appl. No.: 11/356,566

(22) Filed: Feb. 16, 2006

(65) Prior Publication Data

US 2007/0186926 A1 Aug. 16, 2007

(51) Int. Cl.
*B63C 11/02* (2006.01)
*A62B 18/10* (2006.01)
*A62B 9/02* (2006.01)

(52) U.S. Cl. ..... 128/201.27; 128/201.28; 128/205.24

(58) Field of Classification Search ..... 128/201.23, 128/201.27, 201.29, 203.11, 205.24, 201.28; 405/186, 187; 137/512.15, 859
See application file for complete search history.

(56) References Cited

U.S. PATENT DOCUMENTS 3,433,222 A * 3/1969 Pinto ..... 128/201.24
3,680,556 A * 8/1972 Morgan ..... 128/201.15
3,995,627 A * 12/1976 O'Neill ..... 128/201.15
4,250,877 A * 2/1981 Owens et al. ..... 128/207.11
4,819,626 A * 4/1989 Himmens ..... 128/201.28
5,259,374 A * 11/1993 Miller et al. ..... 128/205.24
6,293,733 B1 * 9/2001 Tezuka ..... 405/185
6,394,128 B1 * 5/2002 Concialdi ..... 137/550
6,626,178 B2 * 9/2003 Morgan et al. ..... 128/206.26

FOREIGN PATENT DOCUMENTS

GB 18086471 * 10/1967

* cited by examiner

*Primary Examiner*—Justine R Yu
*Assistant Examiner*—Kristen C Matter
(74) *Attorney, Agent, or Firm*—Cislo & Thomas, LLP

(57) ABSTRACT

A tubular body is operatively coupled to an oral nasal mask and provided with lateral apertures adapted for fluid flow. A flexible valve is mounted onto one end of the tubular body and adapted to seal the lateral apertures under normal operation conditions and expose the lateral apertures for fluid flow during emergency operation conditions. The sealed lateral apertures keep exhaust gases from escaping the oral nasal mask and contaminating the interior of the diving equipment during normal operation conditions. The exposed lateral apertures allow air from an alternate source to reach the mouth and nose of a user covered by the oral nasal mask during emergency operation conditions. The exposed lateral apertures allow excess water to be removed from inside the diving equipment. The valve system may be implemented as an integrated regulator mount nut/valve system.

41 Claims, 11 Drawing Sheets

VALVE SYSTEM FOR UNDERWATER DIVING EQUIPMENT

BACKGROUND

Underwater diving equipment typically includes a breathing regulator that is connected via a hose to a SCUBA (Self Contained Underwater Breathing Apparatus) air tank or a surface supplied air umbilical. Underwater diving equipment comes in a variety of configurations including FFMs (Full Face Masks), diving helmets, SCUBA and/or the like. A wide variety of underwater diving helmets and FFMs has been used over the years. In the beginning, diving helmets were configured basically as upside down buckets that had look-out windows and an air supply hose connected to it that supplied air from the surface to the diver. As time progressed, these helmets became more advanced and the physics of diving better understood.

Modern day diving helmets have been improved in many ways with features like, being able to be connected to a dry suit or the inclusion of a neck dam to keep the water out and the inside of the helmet, most of the time, dry. New breathing systems have been designed including emergency or alternate air sources, and electronic communications have been added, just to name a few.

One problem with the older diving helmets (commonly known as "heavy gear") is that the $CO_2$ that is expired by the diver can build up in the helmet causing a potentially dangerous situation for the diver. Air consumption is another concern. These "heavy gear" diving helmets are essentially free flow helmets, i.e. air is constantly flowing through the helmet to "flush" the $CO_2$ out of the helmet. In these types of helmets, the air flow rates need to be quite high which results in consumption of a great deal of air to maintain a safe $CO_2$ level.

In modern day diving helmets or FFMs, these problems have been solved by using what is commonly known as an "oral nasal" mask. The oral nasal mask is a relatively small rubber mask that is installed on the inside of the diving helmet or FFM to seal against the face of the diver covering his/her nose and mouth. The purpose of the oral nasal mask is to direct the flow of exhaust gases out of the helmet or FFM keeping the $CO_2$ levels within the helmet or FFM to a minimum.

Nowadays, to conserve air, most diving helmets or FFMs use what is called a "demand regulator." This is a breathing regulator, similar to a SCUBA diving regulator, which can be mounted onto a diving helmet or FFM. The demand regulator has a rubber diaphragm that collapses inward with each breath opening a small valve that supplies the diver with air on demand. This small valve is designed to turn off when the diver is exhaling or holding his/her breath conserving the amount of air being consumed by the diver.

The oral nasal mask itself has gone through an evolution. When oral nasal masks were first used, many masks had one or more apertures in the bottom area of the mask that would allow water that had sometimes leaked into the helmet or FFM to pass through to the interior of the oral nasal mask and ultimately be expelled out of the exhaust port of the breathing regulator. In this regard, FIG. 1 schematically shows an aperture 10 in the bottom area of a conventional oral nasal mask 12 covering the mouth and nose of a user 14. Oral nasal mask 12 is disposed within a diving helmet 16, and is operatively coupled to a breathing regulator 18. Helmet water is dumped via aperture 10 and the exhaust port of breathing regulator 18. Helmet water is excess water that may have accumulated in the bottom portion of the helmet. It was later learned that the provision of such aperture(s) was beneficial only when a small amount of water was left over in the bottom of the oral nasal mask. This left over water was instrumental in blocking the exhaust gases from escaping the oral nasal mask via the aperture(s) and contaminating the inside of the diving helmet during exhalation.

Another oral nasal mask configuration, and currently the most commonly used, is one that has a rubber mushroom-type valve installed in the upper portion of the oral nasal mask. A mushroom-type valve is a one-way valve that has a diaphragm resembling a mushroom. The mushroom-type valve in the upper portion of the oral nasal mask is oriented such that the air is allowed to flow from inside the helmet to the interior of the oral nasal mask. A rubber mushroom-type valve 20 disposed within the upper portion of an oral nasal mask 22 is schematically shown, for example, in FIG. 2. Oral nasal mask 22 covers the mouth and nose of a user 24. Oral nasal mask 22 is disposed within a diving helmet 26, and is operatively coupled to a breathing regulator 28. Helmet water is dumped via an additional rubber mushroom-type valve 30 bypassing the exhaust port of breathing regulator 28. Rubber mushroom-type valve 30 is provided in the lower portion of diving helmet 26 (FIG. 2). Helmet water is dumped directly into the surrounding water via mushroom-type valve 30, as shown by directional arrow 32 in FIG. 2.

Most helmets and FFMs presently are equipped with an emergency or alternate air source which is usually controlled by the diver turning a valve that is mounted either to the side of the helmet or FFM or is mounted to the divers harness. When used properly, the alternate air enters the side of the helmet or FFM, as shown, for example, in reference to FIGS. 1-2. For example in FIG. 2, alternate air within helmet 26 enters oral nasal mask 22 via rubber mushroom valve 20. The incoming alternate air within helmet 26 forces excess water built up inside helmet 26 out into the surrounding water via mushroom-type valve 30 (FIG. 2).

SUMMARY

Exemplary embodiments disclosed herein are generally directed to a valve system for underwater diving equipment.

In accordance with one aspect of the invention, the valve system comprises a substantially tubular body provided with a plurality of lateral apertures adapted for fluid flow. The tubular body is operatively coupled to an oral nasal mask which is part of the diving equipment. The valve system also comprises a flexible valve configured for mounting onto one end of the tubular body.

The mounted flexible valve is adapted to seal the lateral apertures from inside the hollow interior of the tubular body under normal operation conditions and expose the same for fluid flow during emergency operation conditions. The sealed lateral apertures keep exhaust gases from escaping the oral nasal mask and contaminating the interior of the diving equipment during normal operation conditions. The exposed lateral apertures allow air within the diving equipment to reach the mouth and nose of a user covered by the oral nasal mask during emergency operation conditions. Excess water accumulated in the diving equipment is dumped outside via the exposed lateral apertures.

In accordance with another aspect of the invention, the valve system comprises a substantially ring-shaped body provided with a plurality of inner annular apertures adapted for fluid flow. The ring-shaped body is operatively coupled between an oral nasal mask and a breathing regulator. The oral nasal mask and breathing regulator are part of the diving equipment. The valve system also comprises a flexible valve configured for mounting within the ring-shaped body.

The mounted flexible valve is adapted to seal the inner annular apertures under normal operation conditions and expose the same for fluid flow during emergency operation conditions. The sealed inner annular apertures keep exhaust gases from escaping the oral nasal mask and contaminating the interior of the diving equipment during normal operation conditions. The exposed inner annular apertures allow air within the diving equipment to reach the mouth and nose of a user covered by the oral nasal mask during emergency operation conditions. Excess water accumulated in the diving equipment is dumped outside via the exposed inner lateral apertures.

In accordance with yet another aspect of the invention, the valve system comprises a substantially tubular valve assembly operatively coupled between an oral nasal mask and a breathing regulator. The oral nasal mask and breathing regulator are part of the diving equipment. The valve system also comprises means for controlling the exhaust gas levels within the diving equipment under normal operation conditions, and means for providing an alternate source of breathing gas for the user under emergency operation conditions. The valve system further comprises means for removing excess water accumulated in the diving equipment when the alternate source of breathing gas is activated by the user.

In accordance with still another aspect of the invention, the valve system comprises a substantially ring-shaped valve assembly operatively integrated between an oral nasal mask and a breathing regulator. The oral nasal mask and breathing regulator are part of the diving equipment. The valve system further comprises means for controlling the exhaust gas levels within the diving equipment under normal operation conditions, and means for providing an alternate source of breathing gas for the user under emergency operation conditions. The valve system also comprises means for removing excess water accumulated in the diving equipment when the alternate source of breathing gas is activated by the user.

These and other aspects of the invention will become apparent from a review of the accompanying drawings and the following detailed description of the invention.

BRIEF DESCRIPTION OF THE DRAWINGS

The present invention is generally shown by way of reference to the accompanying drawings in which.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the present invention.

Some embodiments of the present invention will be described in detail with reference to a valve system for underwater diving helmet or full-face mask applications as generally shown in FIGS. 3-13. Additional embodiments, features and/or advantages of the invention will become apparent from the ensuing description or may be learned by practicing the invention. In the figures, the drawings are not to scale with like numerals referring to like features throughout both the drawings and the description.

Figure 1:
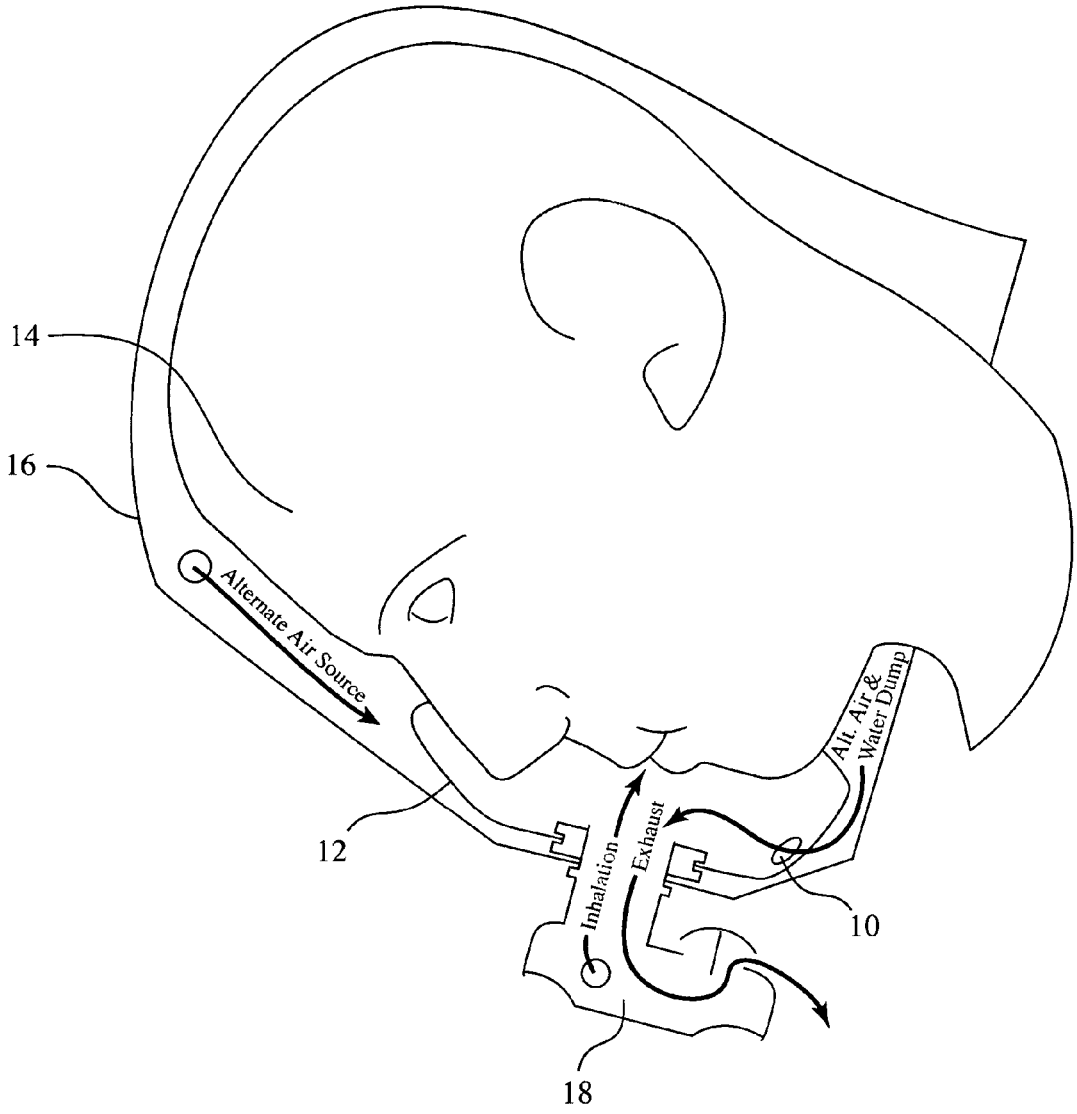
Prior Art Fig. 1
FIG. 1 is a schematic cut away view of a conventional oral nasal system (used in conjunction with a diving helmet) showing the routing of air/exhaust gases within the diving helmet and the path of water removal from the diving helmet.
Figure 2:
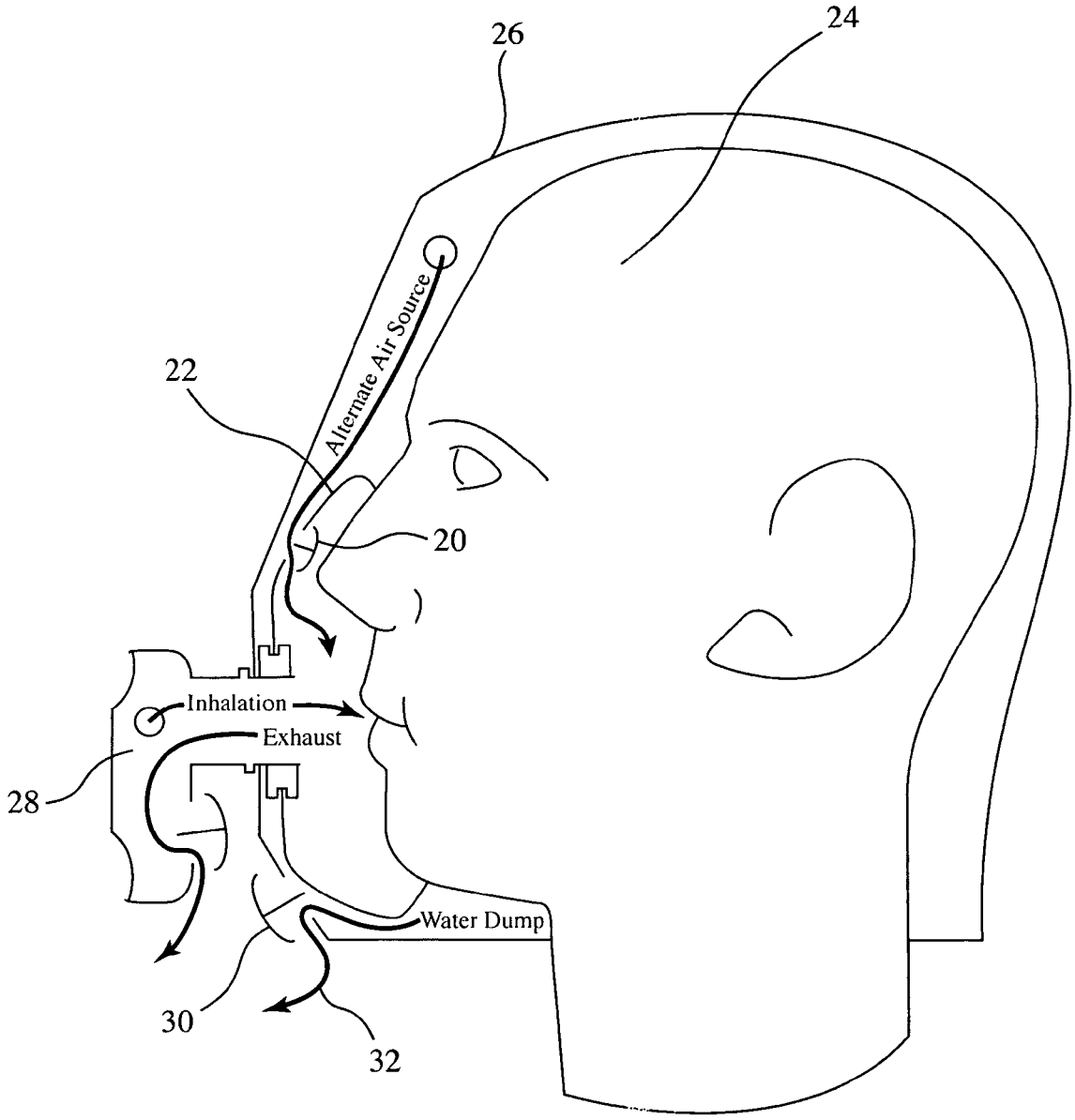
Prior Art Fig. 2
FIG. 2 is a schematic cut away view of another conventional oral nasal system (used in conjunction with a diving helmet) showing the routing of air/exhaust gases within the diving helmet and the path of water removal from the diving helmet.
Figure 3:
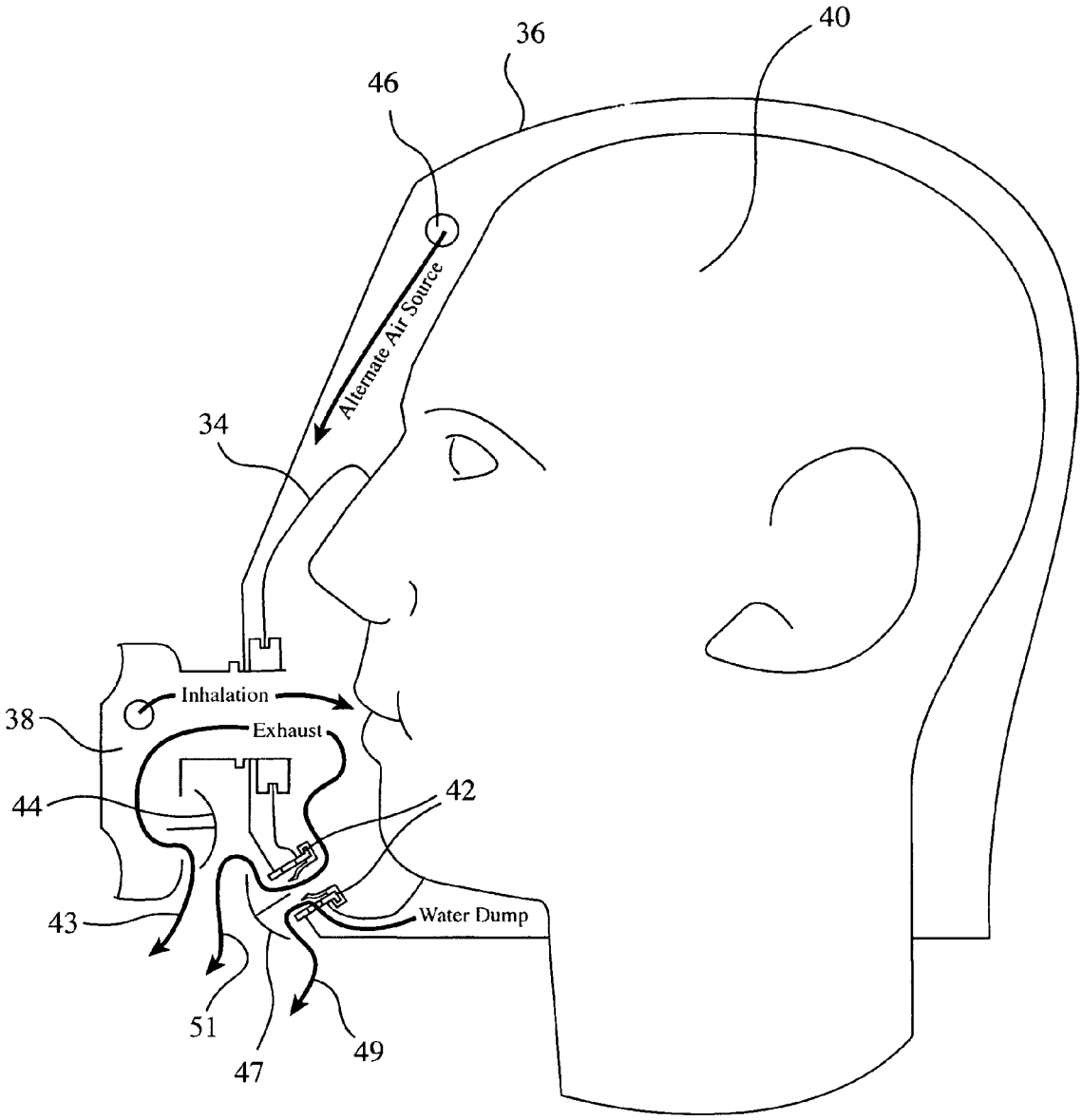
FIG. 3 is a schematic cut away view of an oral nasal mask disposed within a diving helmet and operatively coupled to a breathing regulator with the routing of exhaust gases and helmet water via an integral valve system constructed in accordance with an exemplary embodiment of the present invention.
Figure 6:
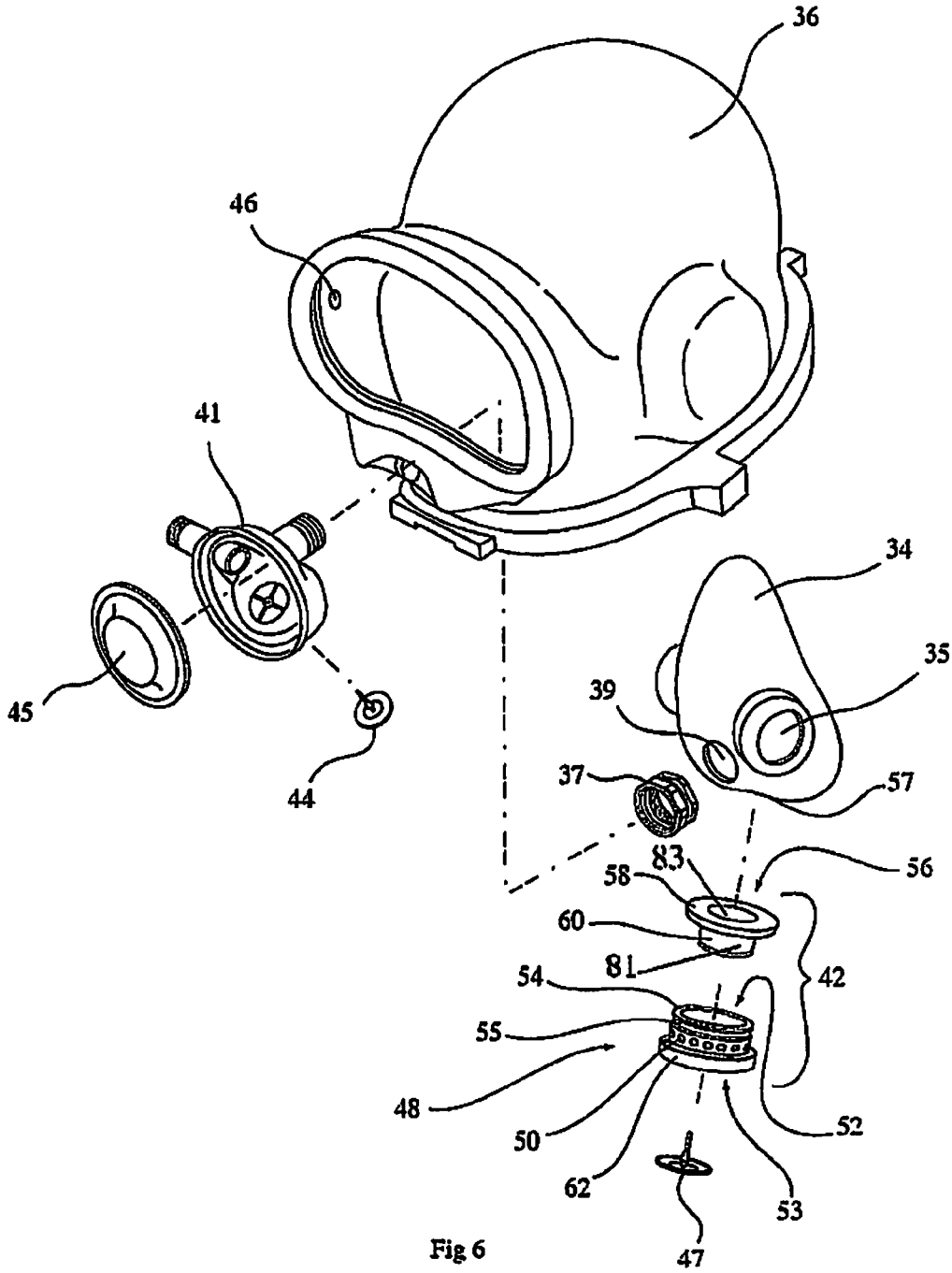
FIG. 6 is an exploded view of the valve system of FIG. 3 with associated breathing regulator components.

FIG. 3 is a cut away view of an oral nasal mask 34 disposed within a diving helmet 36, and operatively coupled to a demand-type breathing regulator 38. Oral nasal mask 34 is configured to cover the mouth and nose of a user 40. Oral nasal mask 34 may be made of elastic material(s) such as natural and/or synthetic rubber. Oral nasal mask 34 includes a side opening 35 (FIG. 6) adapted for mounting a microphone, as well as a frontal opening 39 (FIG. 6) adapted to accommodate a standard breathing regulator mount nut 37 (FIG. 6).

Figure 4:
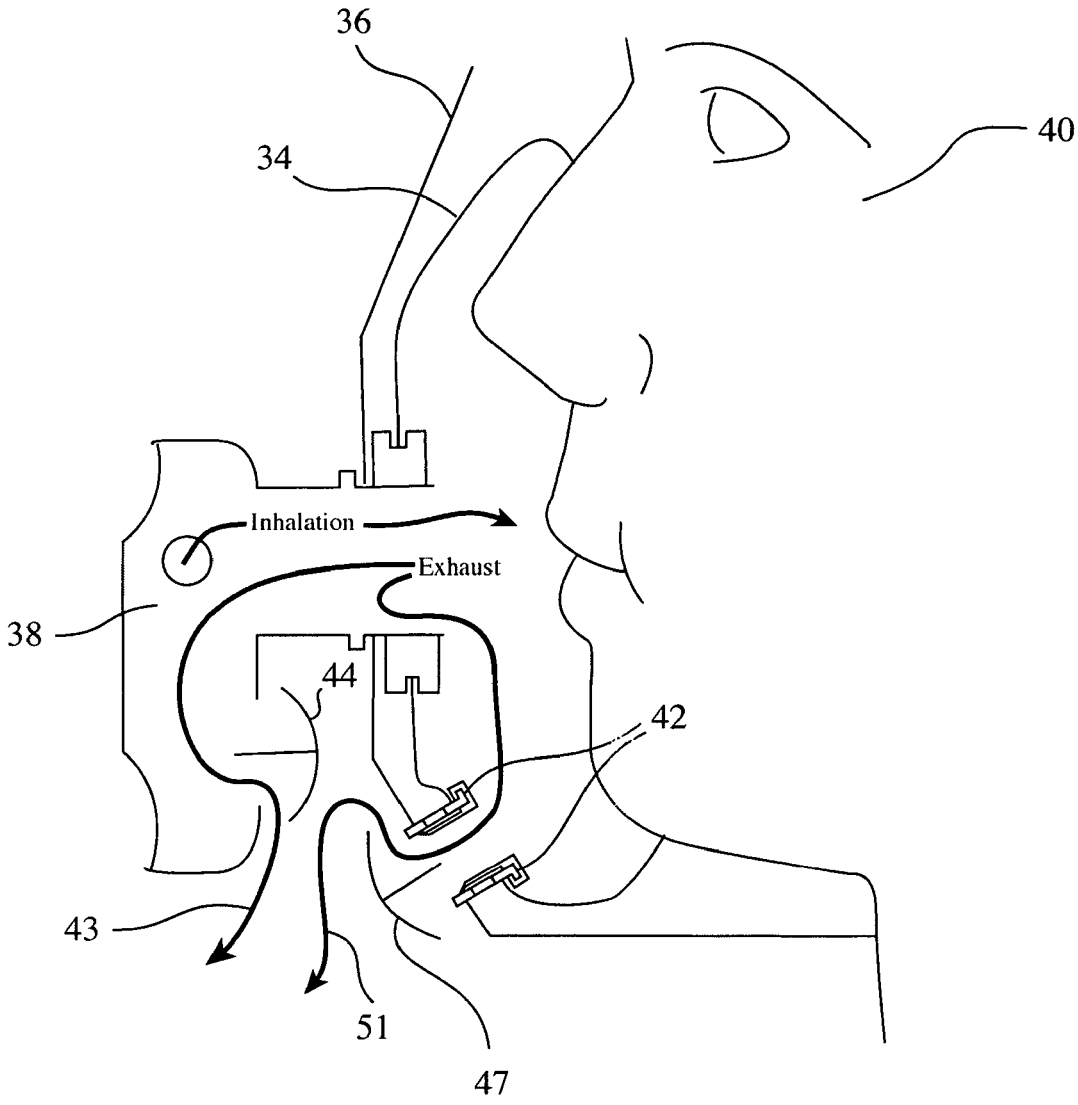
FIG. 4 shows schematically the valve system of FIG. 3 under normal operation conditions.

Breathing regulator 38 (FIGS. 3-5) includes a housing 41 (FIG. 6) adapted at one end to mount to oral nasal mask 34 via nut 37. Regulator housing 41 is adapted to receive a rubber mushroom-type valve 44 (FIGS. 3-6) that is oriented to allow exhaust gases from user 40 to exit breathing regulator 38 defining a main exhaust gas pathway 43 (FIGS. 3-4). Regulator housing 41 is also adapted to receive a standard diaphragm 45 (FIG. 6).

Helmet water is dumped via an integral valve system 42 (FIGS. 3-8) and a mushroom-type valve 47 (FIGS. 3-6) bypassing main exhaust gas pathway 43. The water dump pathway is generally shown by directional arrow 49 in FIGS.

3 and 5. Mushroom-type valve 47 is mounted downstream from integral valve system 42 and oriented to allow helmet water and exhaust gases to exit diving helmet 36 into the surrounding water (FIG. 3). An auxiliary exhaust gas pathway 51 (FIGS. 3-4) is defined by integral valve system 42 and mushroom-type valve 47.

In accordance with an exemplary embodiment of the present invention, integral valve system 42 (FIGS. 3-8) comprises a substantially tubular body 48 (FIG. 6) made from a rigid material, such as metal, plastic and/or the like. Rigid tubular body 48 may have cylindrical walls 89 and is provided with a plurality of lateral apertures 50 (FIGS. 6-8) adapted to allow air from an alternate source 46 (FIGS. 3, 5-6) to reach the user's mouth and nose (covered by oral nasal mask 34) during emergency or helmet water dump operation.

Figure 7:
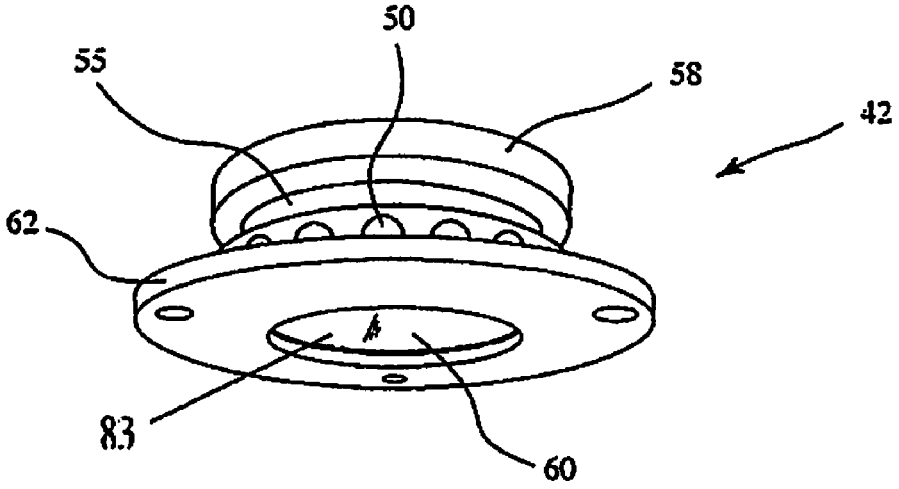
FIG. 7 is a side perspective view of the valve system of FIG. 6 with the valve system being in an closed state.
Figure 8:
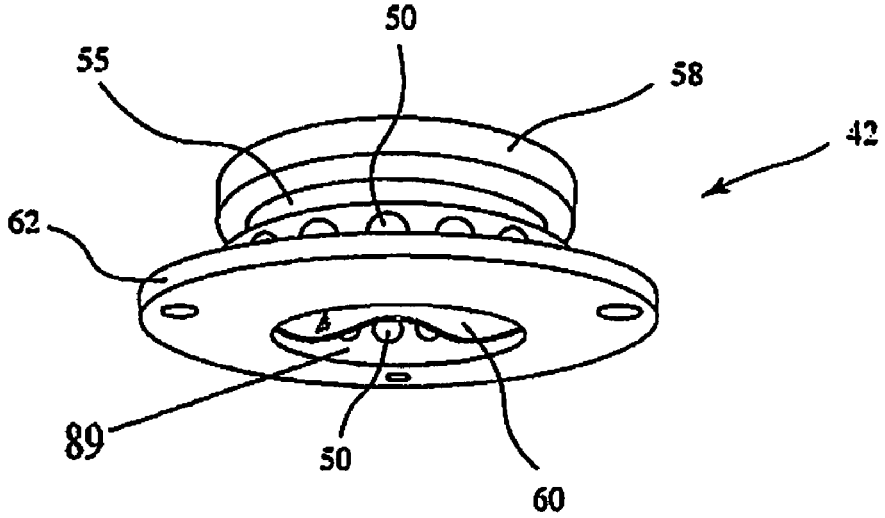
FIG. 8 is a side perspective view of the valve system of FIG. 6 with the valve system being in a partially open state.

Tubular body 48 is provided at a front end 52 (FIG. 6) with an annular outwardly protruding lip 54 (FIG. 6) adapted for mounting a flexible valve 56 (FIG. 6). In this regard, "outwardly protruding" is generally defined as pointing away from the hollow interior of rigid body 48. Rigid body 48 is also provided with an annular groove 55 (FIGS. 6-8) that is disposed between outwardly protruding lip 54 (FIG. 6) and lateral apertures 50 (FIGS. 6-8). Annular groove 55 is used to mount and seal oral nasal mask 34 which is suitably apertured (not shown) at a bottom portion 57 (FIG. 6) thereof.

Tubular body 48 is provided at a rear end 53 with an integral annular flange 62 (FIGS. 6-8) adapted for mounting onto the interior wall surface of helmet 36. In one embodiment, annular flange 62 is screwed and sealed onto the interior surface of the helmet of FFM shell. Other means of mounting tubular body 48 onto the helmet or FFM shell may be utilized, provided such other mounting means do not deviate from the intended scope and spirit of the present invention.

Flexible valve 56 has an annular top 58 (FIGS. 6-8) configured to mount securely onto outwardly protruding lip 54 (FIG. 6) of rigid tubular body 48. Flexible valve 56 also has a tubular body 60 (FIGS. 6-8) configured to match and seal against the inner surface of tubular body 48 completely covering lateral apertures 50 (FIGS. 6-8) from inside. Tubular valve body 60 is disposed under annular top 58 and comprises a cylindrical wall outer surface 81 and a cylindrical wall inner surface 83, as generally shown in FIGS. 6-8. Flexible valve 56 may be made of elastic material such as natural rubber, synthetic rubber and/or the like. The elastic material is suitable for valve use in accordance with the general principles of the present invention. Other valve material(s) or combinations of materials may be utilized, as needed, as long as there is no departure from the intended purpose of the present invention.

Under normal operation conditions, user 40 inhales air from a main air supply via breathing regulator 38 (FIG. 3) with flexible valve 56 (of integral valve system 42) being closed to keep the $CO_2$ gas exhaled by user 40 from escaping oral nasal mask 34 and contaminating the interior of diving helmet 36. Flexible valve 56 is in a "closed" state when its tubular elastic body 60 completely covers (seals) lateral apertures 50 from inside, as generally depicted in FIG. 7.

The exhaled $CO_2$ gas exits oral nasal mask 34 via main exhaust gas pathway 43 (FIGS. 3-4), as well as via auxiliary exhaust gas pathway 51 (FIGS. 3-4) with the latter involving the passage of $CO_2$ gas through the hollow interior of rigid tubular body 48 (FIG. 6) and mushroom-type valve 47 (FIGS. 3-6). With flexible valve 56 in a "closed" state, exhaled $CO_2$ gas from oral nasal mask 34 that passes through the hollow interior of rigid body 48 (FIG. 6) is prevented from entering the interior of helmet 36 via lateral apertures 50 which are completely covered (sealed) on the inside by tubular elastic valve body 60, as generally shown in FIGS. 4 and 7.

The availability of two (main and auxiliary) exhaust gas pathways for exhaled $CO_2$ gas during normal operation conditions helps reduce the exhalation work of breathing for user 40 and lowers breathing resistance. A person skilled in the art would recognize that the two (main and auxiliary) exhaust gas pathways may also be viewed as one common exhaust gas pathway, in which case the auxiliary portion serves advantageously as extension of the main exhaust gas pathway.

Figure 5:
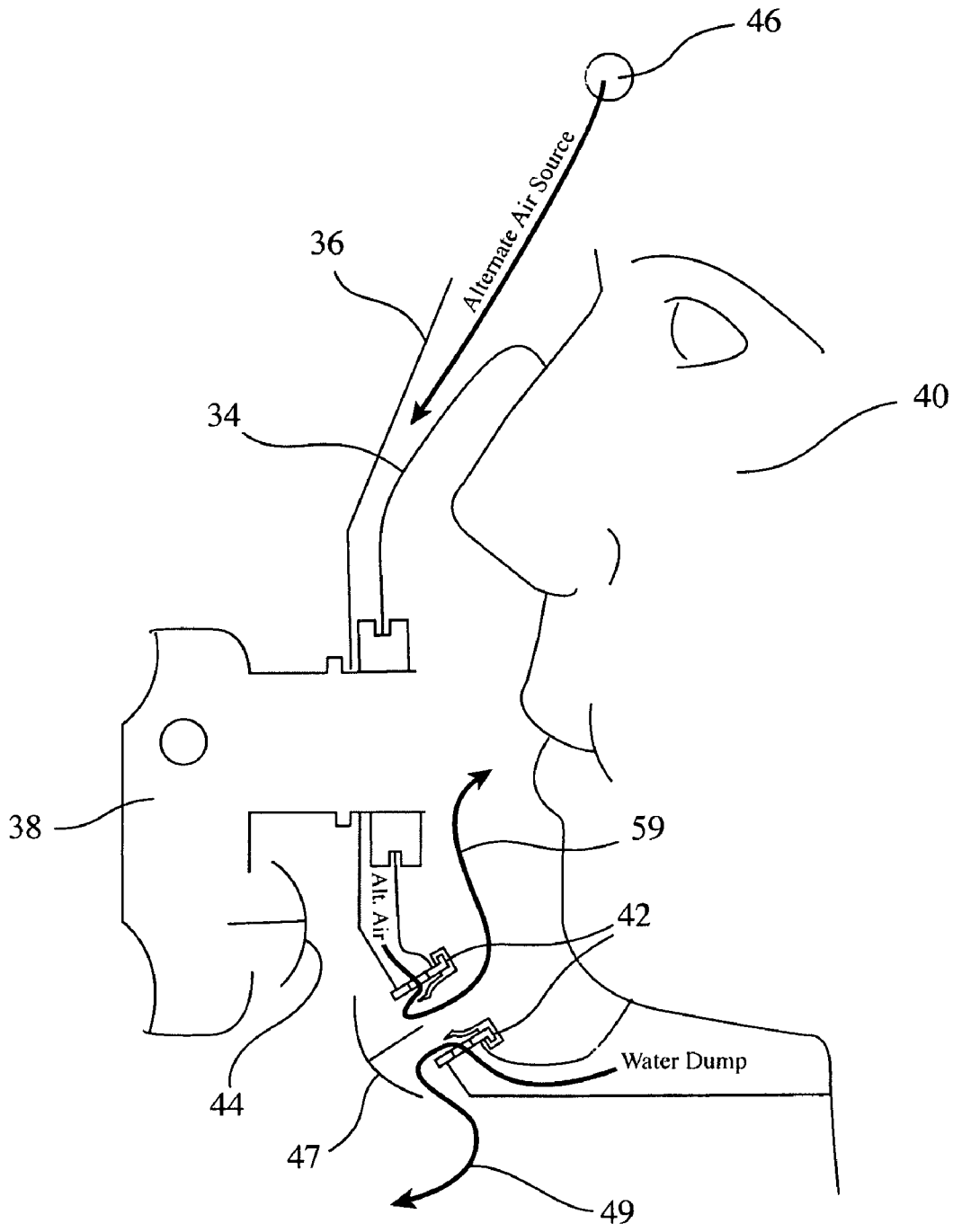
FIG. 5 shows schematically the valve system of FIG. 3 under emergency or helmet water dump operation conditions.

In case of emergency or under helmet water dump operations, user 40 has access to air from an alternate air supply. Alternate air enters diving helmet 36 via port 46 (FIGS. 3, 5-6). The incoming alternate air forces flexible elastic valve 56 to open due to associated pressure increase inside helmet 36. Specifically, tubular elastic valve body 60 is forced to flex radially inward (within the hollow interior of rigid body 48) away from lateral apertures 50 exposing the same for fluid entry, as generally depicted in FIGS. 5 and 8. Alternate air from helmet 36 enters oral nasal mask 34 via exposed apertures 50 (FIG. 8) providing an emergency air supply pathway 59 (FIG. 5) for user 40. The pressure increase inside helmet 36 caused by incoming alternate air also forces helmet water out (into the surrounding water) via exposed lateral apertures 50, as generally shown by directional arrow 49 (FIG. 5).

Figure 11:
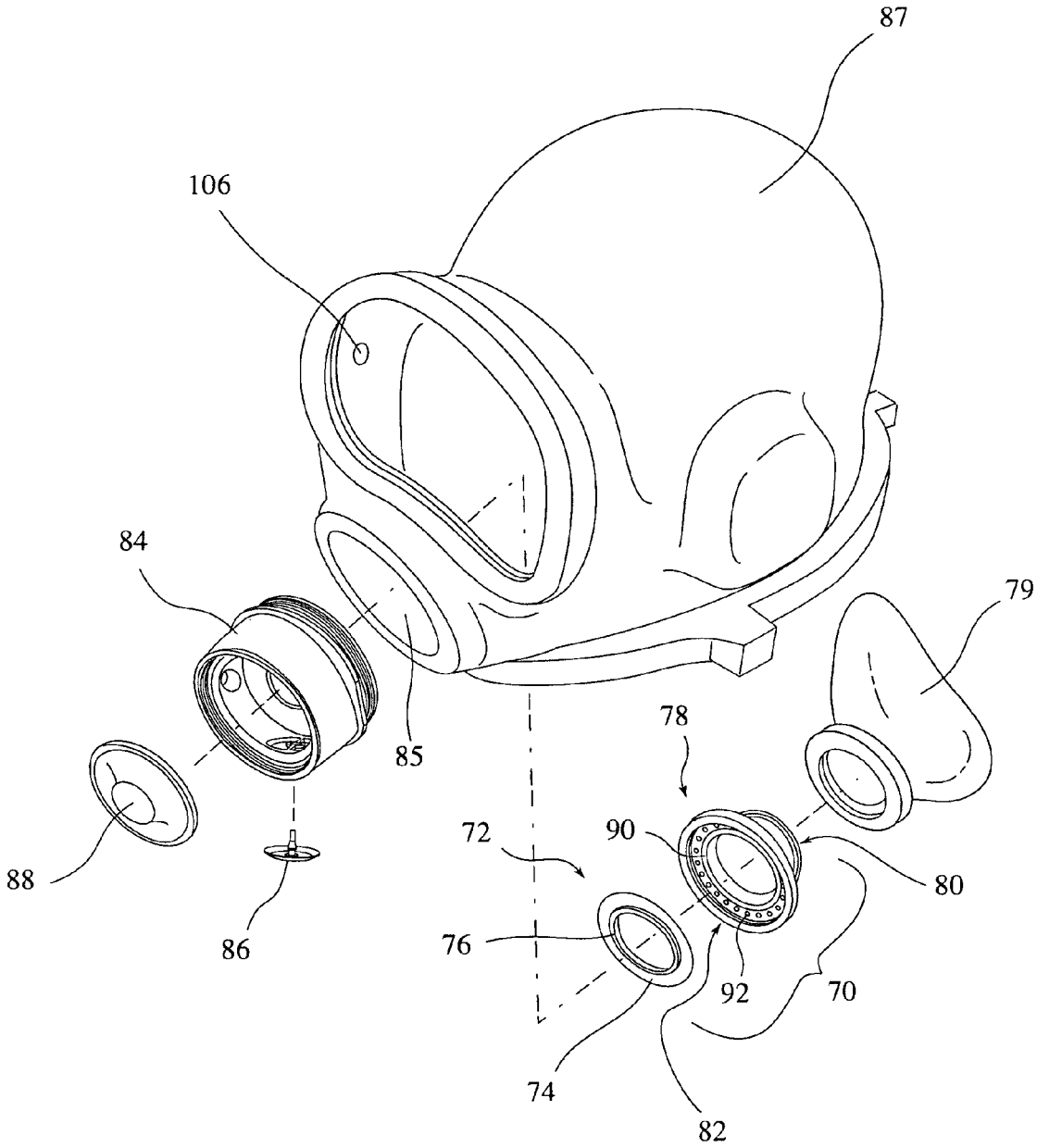
FIG. 11 is an exploded view of the integrated regulator mount nut/valve system of FIG. 9 with associated breathing regulator components.
Figure 12:
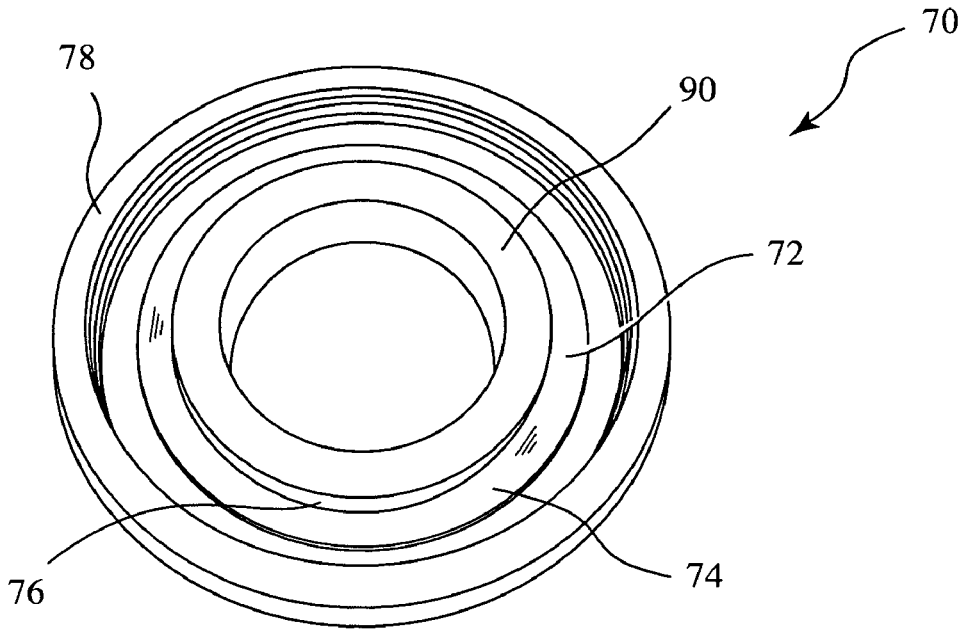
FIG. 12 is a top perspective view of the valve system of FIG. 11 with the valve system being in an closed state.
Figure 13:
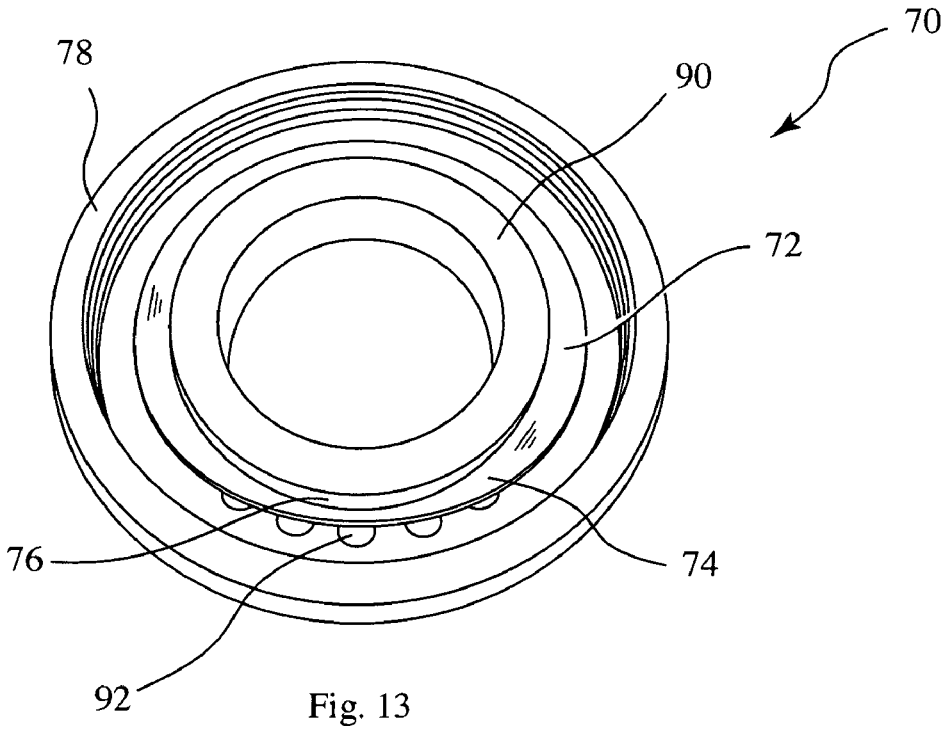
FIG. 13 is a top perspective view of the valve system of FIG. 11 with the valve system being in a partially open state.

In accordance with another exemplary embodiment of the present invention, an integrated breathing regulator mount nut/valve system 70 includes a flexible valve 72 operatively coupled to a substantially ring-shaped body 78 (FIGS. 11-13). Flexible valve 72 includes a tubular member 76 rising from a flat washer-like body 74 (FIGS. 11-13). Flexible valve 72 is made of elastic material such as natural rubber, synthetic rubber and/or the like. The elastic material is suitable for valve use in accordance with the general principles of the present invention.

Figure 9:
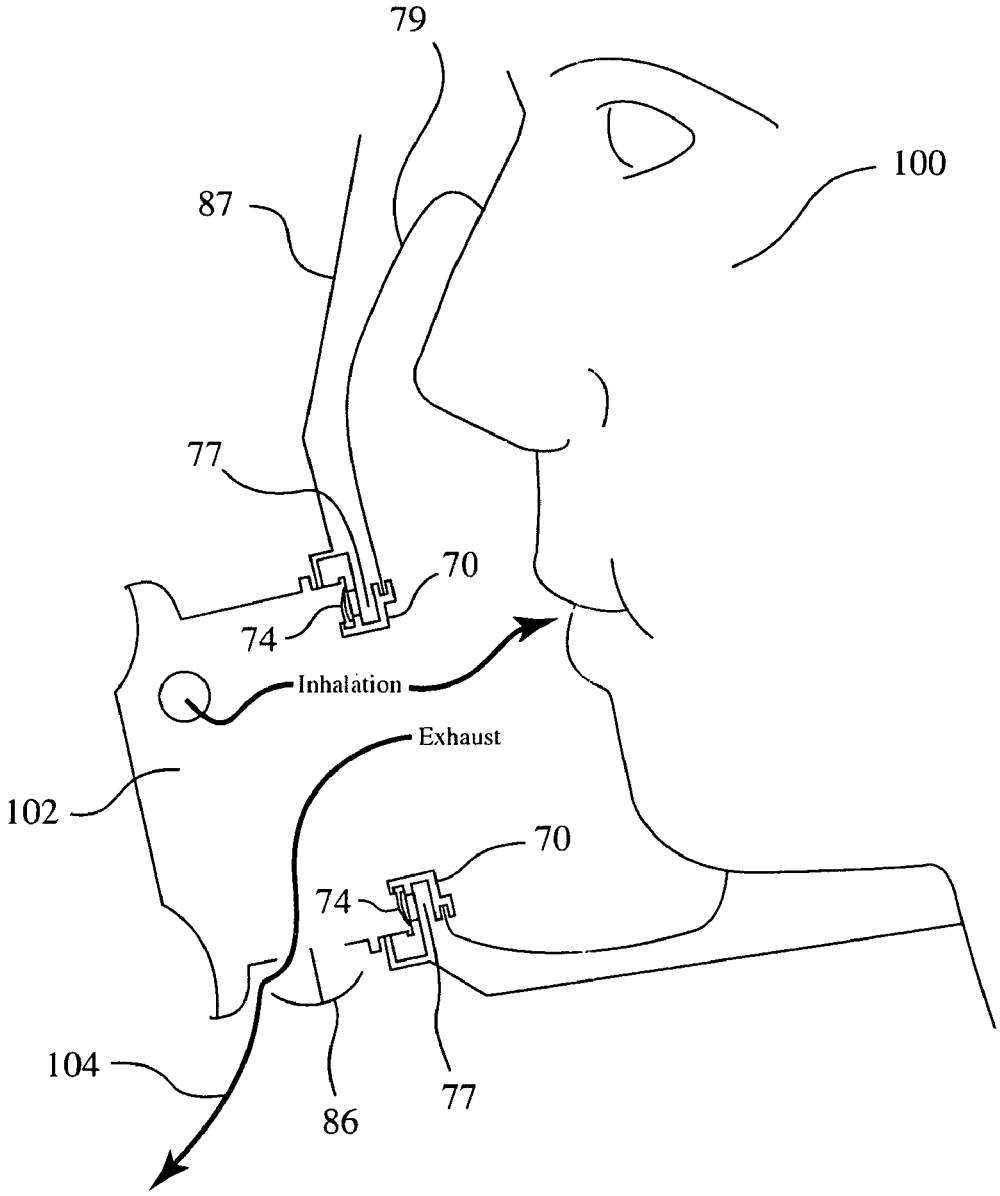
FIG. 9 is a schematic cut away view of an oral nasal mask disposed within a diving helmet and operatively coupled to a breathing regulator with the routing of exhaust gases and helmet water under normal operation conditions via an integrated regulator mount nut/valve system constructed in accordance with another exemplary embodiment of the present invention.
Figure 10:
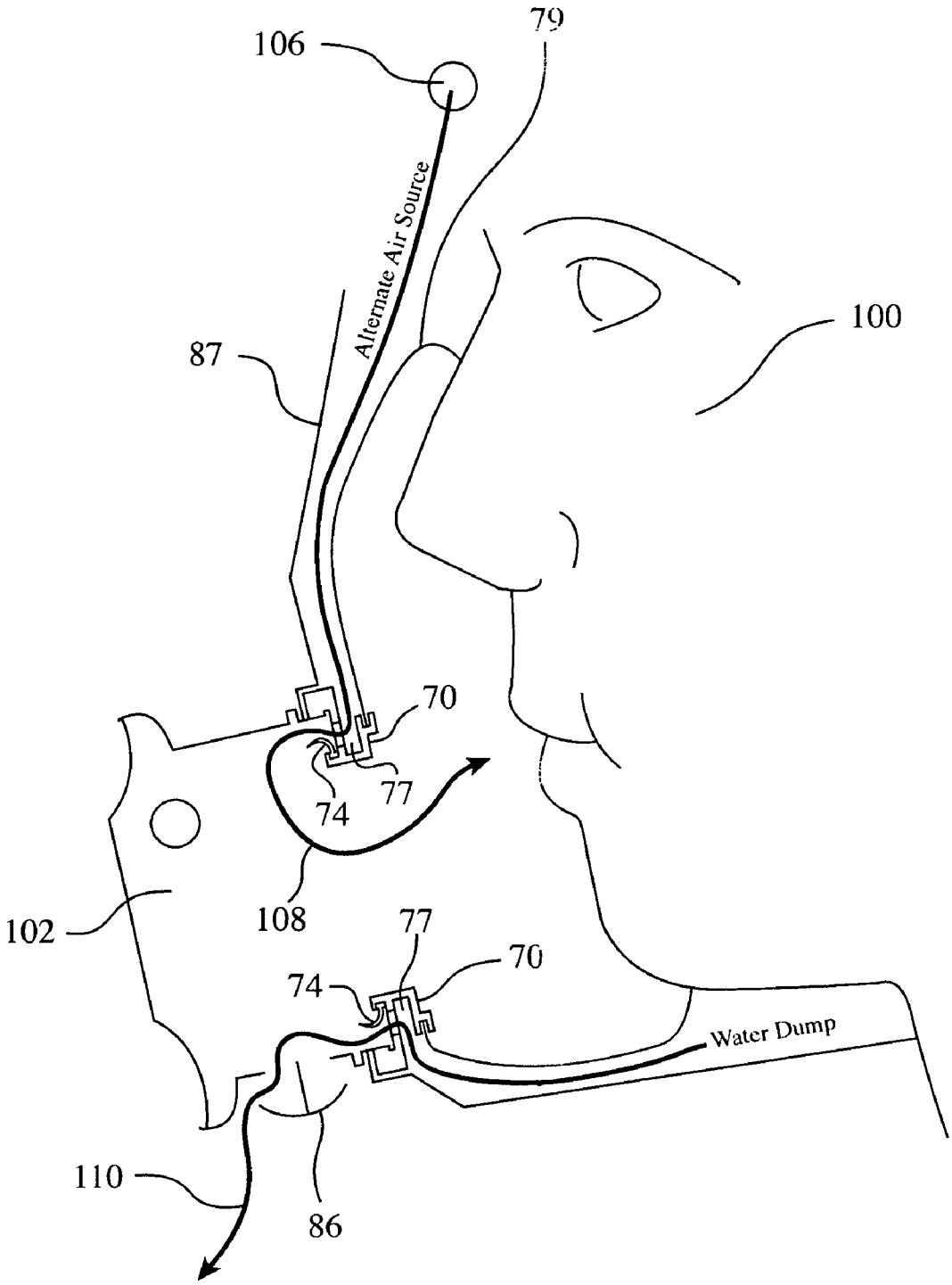
FIG. 10 shows schematically the integrated regulator mount nut/valve system of FIG. 9 under emergency or helmet water dump operation conditions.

Ring-shaped body 78 (FIGS. 11-13) is made from rigid material such as metal, plastic and/or the like. Rigid ring-shaped body 78 is configured at a rear end 80 to operatively mount to an oral nasal mask 79, as generally illustrated in FIG. 11. Ring-shaped body 78 is further configured at a front end 82 to mount to a breathing regulator housing 84 (FIG. 11) via an appropriately configured opening 85 on a diving helmet 87 (FIGS. 9-11). Breathing regulator housing 84 is adapted to receive a mushroom-type valve 86 (FIGS. 9-11) and a standard diaphragm 88 (FIG. 11).

As generally depicted in reference to FIGS. 11-13, ring-shaped body 78 is provided with an inner annular lip 90, which is recessed inward relative to front end 82, and a plurality of inner annular apertures 92 disposed between inner lip 90 and the interior tubular wall surface of rigid body 78. Inner annular apertures 92 are adapted to allow air from an alternate air source to reach the user's mouth and nose (covered by oral nasal mask 79) under emergency or helmet water dump operations.

Inner annular lip 90 is configured to receive and securely retain elastic tubular member 76 of flexible valve 72, as generally shown in FIGS. 12-13. Flat washer-like body 74 (of flexible valve 72) is configured to cover completely (seal) inner annular apertures 92 when tubular member 76 is securely mounted on inner lip 90. Rigid ring-shaped body 78 is also provided with an annular slot 77 (FIGS. 9-10) that provides access to the underside of inner annular apertures 92. Annular slot 77 is disposed proximate to rear end 80 (FIG. 11) of rigid ring-shaped body 78.

Under normal operation conditions, user 100 inhales air from a main air supply via a breathing regulator 102 (FIG. 9). Breathing regulator 102 includes housing 84 (FIG. 11) with associated mushroom-type valve 86 (FIGS. 9-11). In this case, flexible valve 72 (of integrated regulator mount nut/ valve system 70) is closed to keep the $CO_2$ gas exhaled by user 100 from escaping oral nasal mask 79 and contaminating the interior of diving helmet 87. Flexible valve 72 is in a "closed" state when its flat washer-like body 74 completely covers (seals) inner annular apertures 92, as generally depicted in FIG. 12.

The exhaled $CO_2$ gas exits oral nasal mask 79 via regulator exhaust gas pathway 104 (FIG. 9) that includes passage through the hollow interior of rigid ring-shaped body 78 of integrated regulator mount nut/valve system 70 and associated mushroom-type valve 86. With flexible valve 72 in a "closed" state, exhaled $CO_2$ gas from oral nasal mask 79 passing through rigid ring-shaped body 78 is prevented from entering the interior of helmet 87 via inner annular apertures 92 which are completely covered (sealed) by flat washer-like body 74 (FIG. 12).

In case of an emergency or under helmet water dump operations, user 100 has access to air from an alternate air supply. Alternate air enters diving helmet 87 via port 106 (FIGS. 10-11). The incoming alternate air forces flexible elastic valve 72 to open due to associated pressure increase inside helmet 87. Specifically, flat washer-like body 74 is forced to flex away from inner annular apertures 92 exposing the same for fluid entry, as generally depicted in FIG. 13. Alternate air from inside helmet 87 enters oral nasal mask 79 via annular slot 77 and exposed annular apertures 92, providing an emergency air supply pathway 108 for user 100, as generally shown in FIG. 10. The pressure increase inside helmet 87 caused by incoming alternate air also forces helmet water out (into the surrounding water) via annular slot 77, exposed annular apertures 92 and mushroom-type valve 86, as generally shown by water dump pathway 110 (FIG. 10).

Integrated valve system 70 (FIGS. 9-13) advantageously lowers the number of components needed to construct a valve system of the type generally described hereinabove and shown in reference to FIGS. 3-8, while retaining the same functionality.

A person skilled in the art would readily appreciate that the valve system of the present invention in its various embodiments may be adapted for use with a full-face mask (FFM), SCUBA (Self Contained Underwater Breathing Apparatus) diving equipment and/or the like. The diving equipment utilized in accordance with the present invention may receive surface supplied breathing gas via an umbilical. The valve system of the present invention may be assembled in other ways and/or with other suitable components and/or materials, as long as there is no departure from the intended purpose and scope of the present invention.

The exemplary embodiments described hereinabove are merely illustrative of the general principles of the present invention. Various design modifications may be employed that would reside within the scope of the invention. Thus, by way of example, but not of limitation, alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

The invention claimed is:

1. A valve system for underwater diving equipment, said valve system comprising:

a. a substantially rigid body, having cylindrical walls defining a hollow interior and comprising a front end and a rear end, said rigid body comprising a plurality of lateral apertures adapted for fluid flow disposed in the cylindrical walls;

the rigid body further comprising an outwardly protruding lip disposed adjacent the front end;

the substantially rigid body further comprising an annular groove disposed between the lateral apertures and the outwardly protruding lip, said annular groove of the substantially rigid body being operatively coupled to an oral nasal mask, the oral nasal mask being part of the diving equipment; and b. a flexible valve comprising a substantially continuous tubular body defining a hollow interior, the flexible valve further comprising an annular top, wherein the annular top is seated onto the outwardly protruding lip of the rigid body and the tubular body is disposed in the hollow interior of the rigid body, and wherein the tubular body of the flexible valve abuts against the lateral apertures from the hollow interior of the rigid body sealing said lateral apertures from fluid flow under a normal operating condition, and wherein a pressure increase in the diving equipment from incoming air from an alternate air supply causes the flexible valve to flex radially inward within the hollow interior of the rigid body away from the lateral apertures exposing said lateral apertures for fluid entry, said exposed lateral apertures allowing air within the diving equipment from the alternate air supply to reach the mouth and nose of a user covered by the oral nasal mask during emergency operation conditions, and wherein excess water accumulated in the diving equipment is dumped outside via said exposed lateral apertures.

2. The valve system of claim 1, wherein said flexible valve is in a "closed" state during inhalation of air from a main air supply via a breathing regulator during normal operation conditions.

3. The valve system of claim 2, wherein the breathing regulator is operatively coupled between the oral nasal mask and a first one-way valve oriented to pass fluid away from the breathing regulator.

4. The valve system of claim 3, wherein the operatively coupled breathing regulator and said first one-way valve define a main exhaust gas pathway for the user.

5. The valve system of claim 4, wherein said substantially rigid body is operatively coupled between the oral nasal mask and a second one-way valve oriented to pass fluid away from the oral nasal mask.

6. The valve system of claim 5, wherein the hollow interior of said operatively coupled substantially rigid body and said second one-way valve define an auxiliary exhaust gas pathway for the user.

7. The valve system of claim 6, wherein said main and auxiliary exhaust gas pathways help reduce the exhalation work of breathing for the user.

8. The valve system of claim 7, wherein said flexible valve is in an "open" state during inhalation of air from an alternate air supply source during emergency operation conditions, said supplied alternate air forcing said flexible valve to open due to associated pressure increase inside the diving equipment.

9. The valve system of claim 8, wherein alternate air from inside the diving equipment enters the oral nasal mask via said exposed lateral apertures providing an emergency air supply pathway for the user.

10. The valve system of claim 9, wherein said mounted flexible valve includes an elastic tubular body configured to seal said lateral apertures from inside the hollow interior of said substantially rigid body under normal operation conditions.

11. The valve system of claim 10, wherein said elastic tubular body is forced to flex away from said lateral apertures within the hollow interior of said substantially rigid body by incoming alternate air under emergency operation conditions.

12. The valve system of claim 6, wherein each of said first and second one-way valves is a mushroom-type valve.

13. The valve system of claim 2, wherein the breathing regulator is a demand-type breathing regulator.

14. The valve system of claim 1, wherein the underwater diving equipment is a diving helmet.

15. The valve system of claim 1, wherein the underwater diving equipment is a full-face mask (FFM).

16. The valve system of claim 1, wherein the underwater diving equipment is a self contained underwater breathing apparatus (SCUBA).

17. The valve system of claim 1, wherein the underwater diving equipment receives surface supplied breathing gas via an umbilical.

18. The valve system of claim 1, wherein said flexible valve is made of elastic material.

19. A valve system for underwater diving equipment, said valve system comprising:

a. a substantially ring-shaped body provided with a plurality of inner annular apertures adapted for fluid flow and an inner annular lip, said substantially ring-shaped body being operatively coupled between an oral nasal mask and a breathing regulator, the oral nasal mask and breathing regulator being part of the diving equipment; and b. a flexible valve configured for mounting within said substantially ring-shaped body, said flexible valve comprising a substantially continuous elastic tubular member and a washer-like body, wherein the elastic tubular member of the flexible valve is received and retained by the inner annular lip of the substantially ring-shaped body, and wherein the washer-like body of the flexible valve abuts against the ring-shaped body sealing the inner annular apertures when the tubular member is received and retained by the inner lip of the substantially ring-shaped body under normal operation conditions, said sealed inner annular apertures keeping exhaust gases from escaping the oral nasal mask and contaminating the interior of the diving equipment during normal operation conditions, and wherein incoming air from an alternate air source causes the washer-like body to flex radially away from the inner annular apertures exposing said inner annular apertures for fluid entry, said exposed inner annular apertures allowing air within the diving equipment to reach the mouth and nose of a user covered by the oral nasal mask during emergency operation conditions, wherein excess water accumulated in the diving equipment is dumped outside via said exposed inner annular apertures.

20. The valve system of claim 19, wherein said flexible valve is in a "closed" state during inhalation of air from a main air supply via the breathing regulator and the hollow interior of said substantially ring-shaped body during normal operation conditions.

21. The valve system of claim 20, wherein the breathing regulator is operatively coupled to a one-way valve oriented to pass fluid away from the breathing regulator.

22. The valve system of claim 21, wherein the operatively coupled breathing regulator, the hollow interior of said substantially ring-shaped body, and said one-way valve define an exhaust gas pathway for the user.

23. The valve system of claim 22, wherein said flexible valve is in an "open" state during inhalation of air from an alternate air supply source during emergency operation conditions, said alternate air forcing said flexible valve to open due to associated pressure increase inside the diving equipment.

24. The valve system of claim 22, wherein said substantially ring-shaped body is further provided with an annular slot, said annular slot providing access to the underside of said annular apertures, said annular slot being disposed proximate to one end of said substantially ring-shaped body.

25. The valve system of claim 24, wherein alternate air from inside the diving equipment enters the oral nasal mask via said annular slot and said exposed inner apertures providing an emergency air supply pathway for the user.

26. The valve system of claim 25, wherein said mounted flexible valve includes a substantially flat washer-like body configured to seal said inner annular apertures of said substantially ring-shaped body under normal operation conditions.

27. The valve system of claim 26, wherein said substantially flat washer-like body is forced to flex away from said inner annular apertures of said substantially ring-shaped body by incoming alternate air under emergency operation conditions.

28. The valve system of claim 26, wherein said mounted flexible valve further includes a tubular member configured for mounting within said substantially ring-shaped body.

29. The valve system of claim 25, wherein said annular slot, said exposed inner apertures, and said one-way valve define an excess water dump pathway for the user.

30. The valve system of claim 21, wherein said one-way valve is a mushroom-type valve.

31. The valve system of claim 19, wherein the breathing regulator is a demand-type breathing regulator.

32. The valve system of claim 19, wherein said substantially ring-shaped body has an integrated regulator mount nut functionality.

33. The valve system of claim 19, wherein the underwater diving equipment is a diving helmet.

34. The valve system of claim 19, wherein the underwater diving equipment is a full-face mask (FFM).

35. The valve system of claim 19, wherein the underwater diving equipment is a self contained underwater breathing apparatus (SCUBA).

36. The valve system of claim 19, wherein the underwater diving equipment receives surface supplied breathing gas via an umbilical.

37. The valve system of claim 19, wherein said substantially ring-shaped body is made of rigid material.

38. The valve system of claim 19, wherein said flexible valve is made of elastic material.

39. A valve system for underwater diving equipment, said valve system comprising:

a) a substantially tubular valve assembly operatively coupled between an oral nasal mask and a breathing regulator, the oral nasal mask and breathing regulator being part of the diving equipment;

b) means for controlling the exhaust gas levels within the diving equipment under normal operation conditions;

c) means for providing an alternate source of breathing gas for the user under emergency operation conditions; and d) means for removing excess water accumulated in the diving equipment when the alternate source of breathing gas is activated by the user, wherein the substantially tubular valve assembly comprises a substantially rigid body having a hollow interior and a plurality of lateral apertures adapted for fluid flow, and a flexible valve having a substantially continuous tubular body disposed within the interior of the substantially rigid body, said flexible valve abutting against the rigid body from the hollow interior of the substantially rigid body sealing said lateral apertures from inside the interior of said substantially rigid body under normal operating conditions, and wherein said tubular body flexes radially away from the lateral apertures to expose the lateral apertures for fluid entry under emergency operation conditions.

40. A valve system for underwater diving equipment, said valve system comprising:

a. a substantially ring-shaped valve assembly operatively integrated between an oral nasal mask and a breathing regulator, the oral nasal mask and breathing regulator being part of the diving equipment;

b. means for controlling the exhaust gas levels within the diving equipment under normal operation conditions;

c. means for providing an alternate source of breathing gas for the user under emergency operation conditions; and d. means for removing excess water accumulated in the diving equipment when the alternate source of breathing gas is activated by the user, wherein the substantially ring-shaped valve assembly comprises an annular lip and a plurality of lateral apertures adapted for fluid flow, and wherein the valve system comprises a flexible valve having a tubular member and a substantially continuous washer-like body, and wherein said tubular member is disposed on the inner lip of the ring-shaped body and the washer-like body abuts against the ring-shaped body substantially completely covering said lateral apertures under normal operating conditions, and wherein said washer-like body flexes radially inward away from the lateral apertures to expose the lateral apertures for fluid entry under emergency operation conditions.

41. An integrated valve system for underwater diving equipment, said valve system comprising:

a. a rigid tubular body having a front end and a rear end and including:

(i) cylindrical walls defining a hollow interior;

(ii) a plurality of lateral apertures disposed in the cylindrical walls of the rigid tubular body;

(iii) an outwardly protruding lip disposed adjacent the front end;

(iv) an annular groove disposed between the lateral apertures and the outwardly protruding lip, the annular groove being operatively coupled to an oral nasal mask, the oral nasal mask being part of the diving equipment;

(v) an annular flange disposed adjacent the rear end, the annular flange being mounted onto an interior wall of a dive helmet;

b. a flexible valve comprising a tubular body and an annular top disposed above the tubular body, the tubular body having a cylindrical wall outer surface and a cylindrical wall inner surface defining a hollow interior, wherein a perimeter of the cylindrical wall outer surface of the flexible valve is approximately equal to a perimeter of the hollow interior of the rigid tubular body, and wherein the annular top of the flexible valve is mounted onto the outwardly protruding lip and the tubular body of the flexible valve is seated in the hollow interior of the rigid tubular body, and wherein the cylindrical wall outer surface of the flexible valve abuts against the lateral apertures sealing said lateral apertures from fluid flow when pressure inside the hollow interior of the flexible valve tubular body is equal to or greater than pressure on the cylindrical wall outer surface, said sealed lateral apertures keeping exhaust gases from escaping the oral nasal mask and contaminating the interior of the diving equipment during normal operating conditions, and wherein the tubular body of the flexible valve flexes radially inward when pressure on the cylindrical wall outer surface is greater than pressure in the hollow interior of the flexible valve tubular body exposing the lateral apertures for fluid flow, said exposed lateral apertures allowing air within the diving equipment from an alternate air supply to reach a mouth and nose of a user covered by the oral nasal mask during emergency operation conditions and wherein excess water accumulated in the diving equipment is dumped outside via said exposed lateral apertures.

* * * * *